United States Patent [19]

Morrison

[11] 4,236,695

[45] Dec. 2, 1980

[54] SEA SWELL COMPENSATION

[76] Inventor: Archibald J. S. Morrison, 3 Lyle Rd., Greenock PA16 7QT., Scotland

[21] Appl. No.: 952,993

[22] Filed: Oct. 20, 1978

[30] Foreign Application Priority Data

| | | | |
|---|---|---|---|
| Oct. 27, 1977 | [GB] | United Kingdom | 44693/77 |
| Nov. 2, 1977 | [GB] | United Kingdom | 45494/77 |
| Nov. 8, 1977 | [GB] | United Kingdom | 46333/77 |
| Feb. 16, 1978 | [GB] | United Kingdom | 6141/78 |

[51] Int. Cl.[3] ..... B66D 1/48

[52] U.S. Cl. ..... 254/277; 175/5, 91/6, 32; 254/266, 386, 392

[58] Field of Search ..... 254/172, 173, 188, 189; 187/26, 17; 175/5

[56] References Cited

U.S. PATENT DOCUMENTS

| | | | |
|---|---|---|---|
| 3,343,810 | 9/1967 | Parnell | 254/172 |
| 3,718,316 | 2/1973 | Larraide | 254/172 |
| 3,721,293 | 3/1973 | Ahlstone | 254/172 |
| 3,841,607 | 10/1974 | Larraide | 254/172 |

*Primary Examiner*—Edward J. McCarthy

*Attorney, Agent, or Firm*—Mason, Fenwick & Lawrence

[57] ABSTRACT

A hoist includes a winch and a hoist rope having load attaching means on one end and a hydraulically-operated ram to heave in and pay out the hoist rope. Two hydraulic systems each including a gas accumulator are connected to the hydraulically-operated ram with selection means acting to selectively connect the hydraulic systems with the hydraulically-operated ram. The hydraulically-operated ram is biased so as to tend to heave the hoist rope by the gas pressure in the accumulators which are at different predetermined pressures so that the hydraulically-operated ram acts to support the weight of a load under the control of one accumulator to maintain tension in the hoist rope when the load is not fully supported by the hoist rope to compensate for relative motion between the load and the hoist; the other accumulator causes the hydraulically-operated ram to heave in the hoist rope when the hoist rope is tensioned and the load is entirely supported by the hoist rope. In an alternative construction the ram is replaced by a pump-motor.

10 Claims, 11 Drawing Figures

SEA SWELL COMPENSATION

This invention relates to a sea swell and shock load compensator and to a hoist, incorporating such a compensator, for use in transferring or supporting a load either between two stations at least one of which is floating in water subject to a swell or between a single station, which is either floating in the water or fixed, and the water itself, and for installation at either of the two stations or at the single station. An example of the application of the invention is a crane for use on offshore oil or gas rigs and platforms.

There have been numerous accidents involving cranes mounted on offshore oil or gas rigs and platforms used to transfer equipment or other loads to and from tenders. Apart from cranes being wrenched from their mountings and falling overside there is a high accident rate to crews of tenders discharging and receiving loads and numerous cases of damage both to the loads being transferred and to the tenders themselves when attempting to transfer loads under adverse weather conditions. On the financial side, a great deal of cost is incurred in awaiting weather conditions under which it is reasonably safe to transfer loads.

According to one aspect of the invention there is provided a sea swell and shock load compensator comprising a hydraulically-operated means for heaving in and paying out a hoist rope, a high pressure hydraulic system for supplying hydraulic fluid to the means so as to enable the means to heave in the hoist rope when carrying a load under a given maximum load, and a low pressure hydraulic system for supplying hydraulic fluid to the means so as to enable the means to heave in the hoist rope when carrying a load under a given lesser load, the hydraulic systems being pressurised by gas-loaded accumulators, and selection means for selectively connecting the hydraulic systems with the hydraulically operated means.

According to another aspect of the invention there is provided a hoist for use in transferring or supporting a load either between two stations at least one of which is floating in water subject to a swell or between a single station, which is either floating in the water or fixed, and the water itself, and for installation at either of the two stations or at the single station, the hoist comprising a hoist rope, means for attaching a load to the hoist rope, a hydraulically-operated means to heave in and pay out the hoist rope, two hydraulic systems connected to the hydraulically-operated means, and selection means for selectively putting one of said systems into communication with the hydraulically-operated means and isolating the other from the hydraulically-operated means, each one of the hydraulic systems including a gas-loaded accumulator, the hydraulically-operated means being biassed towards heaving in the hoist rope by the gas pressure in the accumulator in the hydraulic system with which the hydraulically-operated means is in communication, and the accumulators being gas-loaded to different predetermined pressures, one of which pressures is lower than that required to enable the hydraulically-operated means to support the weight of a load but high enough to maintain tension in the hoist rope when the load-attaching means is attached to a load substantially supported by means other than the hoist rope and thereby to compensate for relative motion between the two stations or between the single station and the water, and the other of which pressures is at least sufficient to enable the hydraulically operated means to heave in the hoist rope when the hoist rope is tensioned and the load is entirely supported by the hoist rope.

Embodiments of the invention will now be described, by way of example, with reference to the accompanying drawings, in which.

Figure 1:
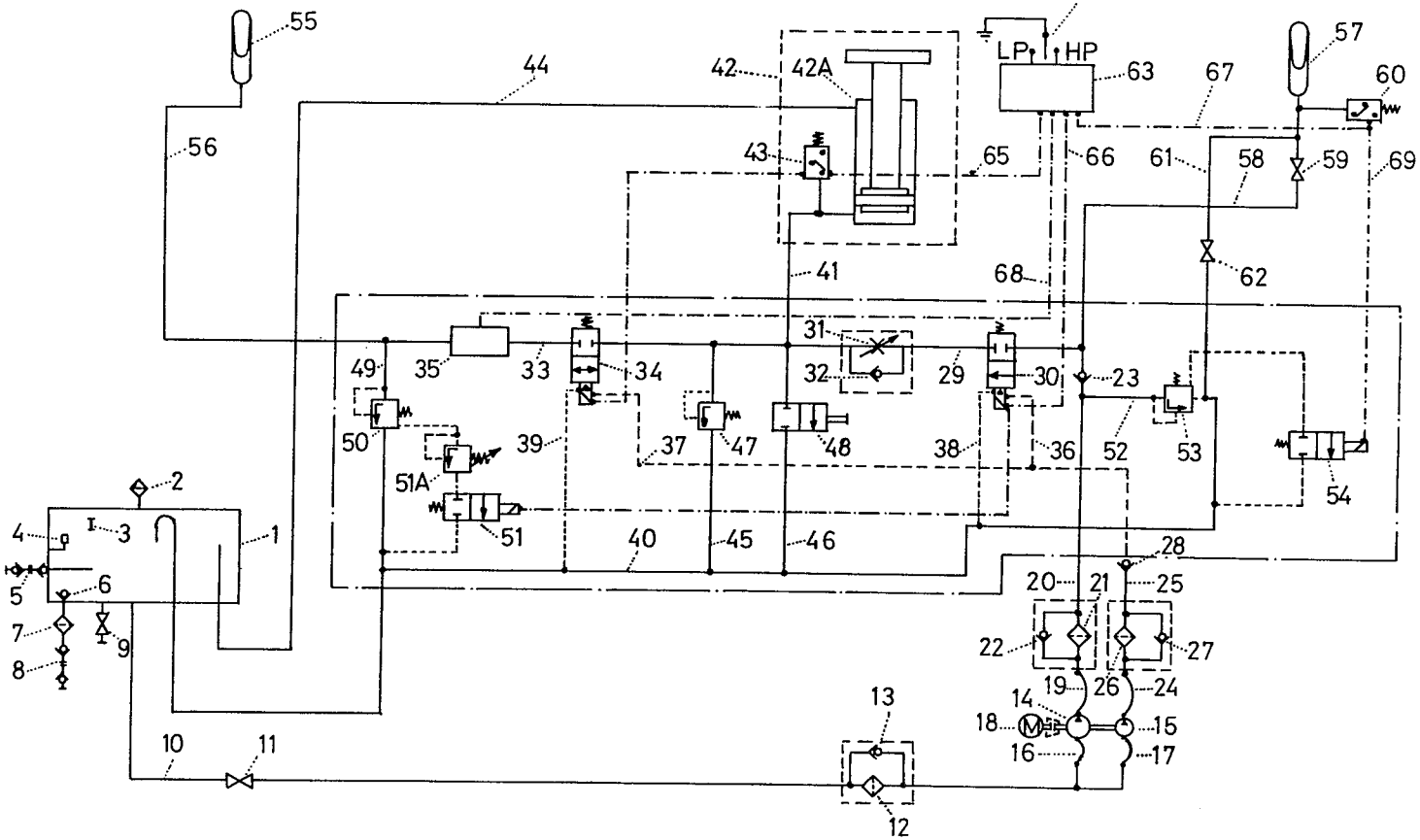
FIG. 1 shows, diagrammatically, for incorporation in a hoist, part of a sea swell and shock load compensator controlled by a hydraulic circuit having both high and low pressure hydraulic systems.
Figure 6:
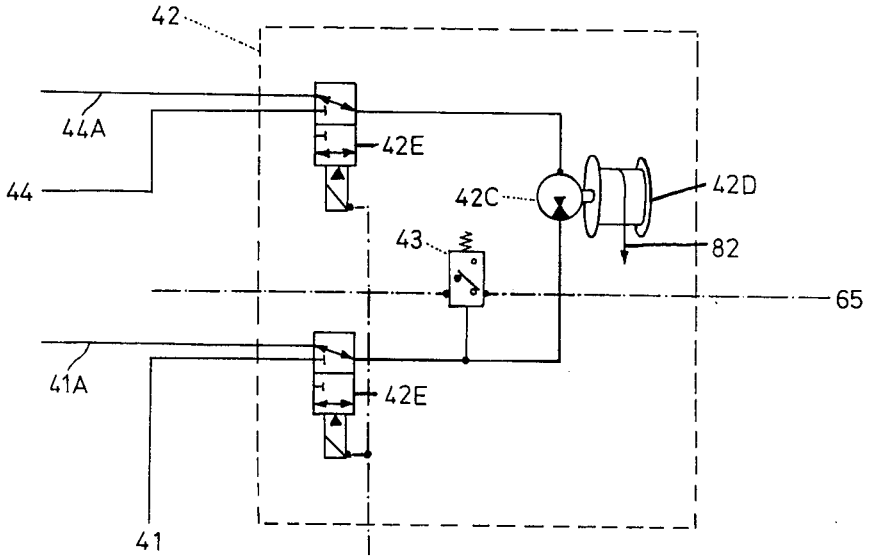
Figure 5A:
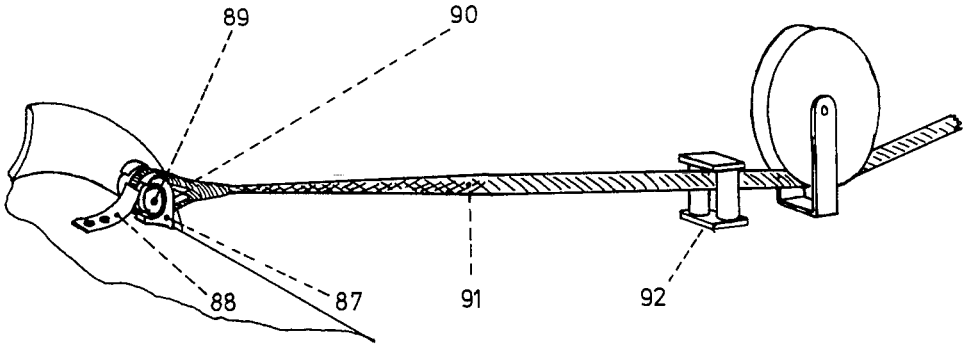
Figure 5B:
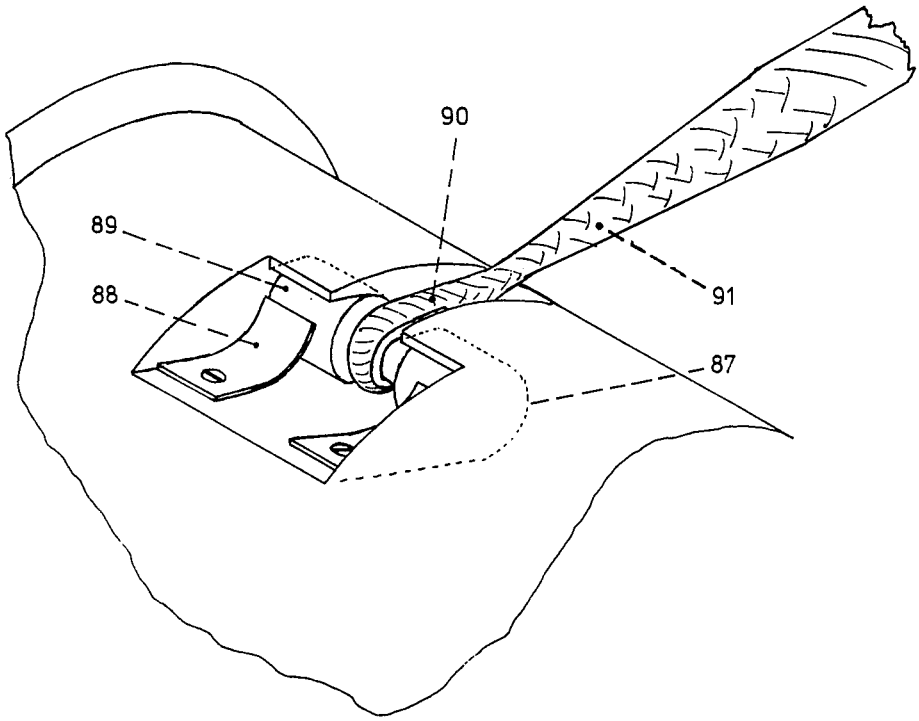

FIGS. 5A and 5B show means whereby the hoist rope can part company with the hoist winch when the hoist rope is paid out to the full; and FIG. 6 shows a modification of the hydraulic circuit of FIG. 1 applicable to the use of sea swell and shock load compensator including, instead of a ram or rams, a hydraulic pump-motor capable of acting as a pump driven by a winch when hoist rope is being paid out or of acting as a motor driving the winch when the hoist rope is being hove in.

In FIG. 1 a hydraulic fluid reservoir 1 has a flitered breather 2, a level gauge 3, a float switch 4, a self-sealing sampler 5, a check valve 6, a filling filter 7, a self-sealing filler 8 and shut off valve 9. A suction line 10 from the reservoir 1 includes a shut off valve 11 and a filter 12 across which is connected a check valve 13 for alternative passage of fluid should the filter 12 become clogged. The suction line 10 is connected to the inlet sides of a high capacity pump 14 and a low capacity pump 15 via flexible hoses 16 and 17 respectively. The pumps 14 and 15 are driven by a single motor 18. The outlet side of pump 14 is connected by a flexible hose 19 to an output line 20 which includes a filter 21, across which is connected a check valve 22 for alternative passage of fluid should the filter 21 become clogged, and a check valve 23. Likewise, the outlet side of pump 15 is connected by a fexible hose 24 to an output line 25 which includes a filter 26, across which is connected a check valve 27 for alternative passage of fluid should the filter 26 become clogged, and a check valve 28.

The line 20 is connected to a line 29 including a 2/2 directional control valve 30 controlled by a solenoid operated hydraulic pilot valve with a return spring biassing the valve 30 to a closed position, and an adjustable restriction 31 across which is connected a check valve 32. The line 29 is connected to a line 33 including another 2/2 directional control valve 34 controlled by a solenoid operated hydraulic pilot valve with a return spring biassing the valve 34 to a closed position, and a flow meter or pressure switch 35. The line 25 is connected by lines 36, 37 to the pilot valves embodied in the directional control valves 30 and 34, and lines 38, 39 interconnect the respective pilot valves with a common return line 40 back to the reservoir 1.

From the junction of the lines 29 and 33 a line 41 to the pressure end of a hydraulic ram 42A and a pressure switch 43 is connected to the line 41 to sense the pressure therein. A compensator unit 42 includes the ram 42A and the switch 43. A return line 44 interconnects the other end of the ram 42A and the reservoir 1. Also from the junction of the lines 29 and 33 two lines 45 and 46 lead to the common return line 40. In the line 45 there is a sequence valve 47 and in the line 46 there is a manually operated 2/2 directional control valve 48. In a line 49 interconnecting the end of line 33 remote from line 29 and the common return line 40 is another sequence valve 50 with a return spring. A 2/2 directional control valve 51 controlled by a solenoid with a return spring biassing the valve 51 to a closed position is connected between the valve 50 and the common return line 40 to open a direct connection between the lines 40 and 49. In the line between sequence valve 50 and directional control valve 51 is another sequence valve 51A with an adjustable return spring. In a line 52 connected between the line 20 on the pump side of valve 23 and the common return line 40 a sequence valve 53 is provided and a 2/2 directional control valve 54 controlled by a solenoid with a return spring biassing the valve 54 to a closed position is connected between the valve 53 and the common return line 40 to open a direction connection between the lines 20 and 40.

A low pressure gas-loaded accumulator 55 with a bladder is connected by a line 56 to the junction of lines 33 and 49. Furthermore, a high pressure gas-loaded accumulator 57 with a bladder is connected by a line 58 to the junction of lines 29 and 52 which includes a shut-off valve 59. A pressure switch 60 is connected to the line 58 to sense the pressure therein. Another line 61 including a shut-off valve 62 interconnects the line 58, at a point between the shut-off valve 59 and the connection with the pressure switch 60, and the line 52, on the side of the sequence valve 53 connected to the common return line 40.

An electrical control panel 63 has a two position switch 64 for selection of high pressure or lift operation and low pressure or compensation operation. The control panel 63 is electrically connected by a line 65 including the pressure switch 43 to the solenoid of the directional control valve 34, by a line 66 to the solenoids of directional control valves 30 and 51, by a line 67 to the pressure switch 60, and by a line 68 to the flow meter or pressure switch 35. The switch 60 is also connected to the solenoid of the directional control valve 54 by a line 69.

Figure 2:
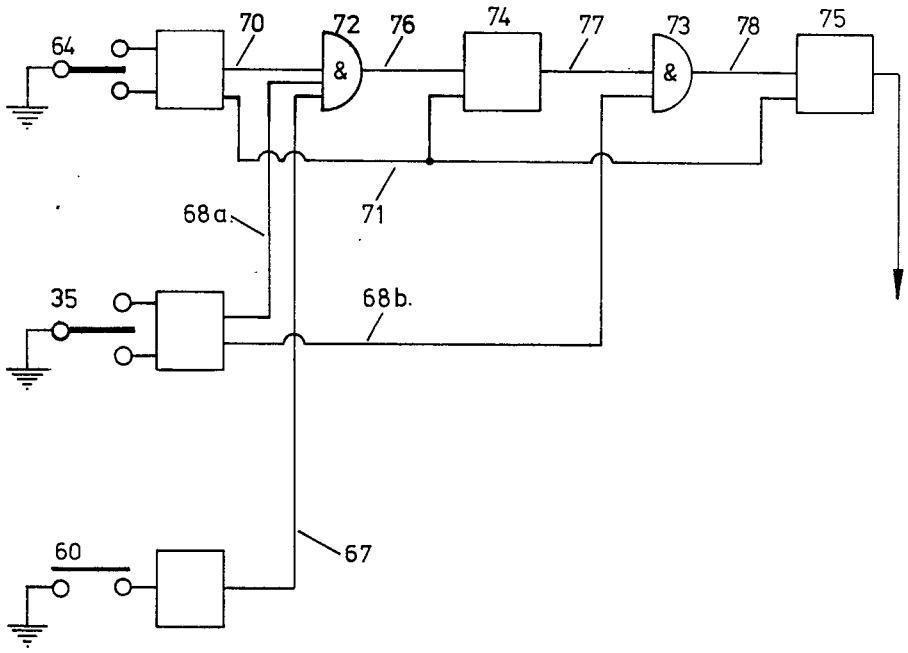
FIG. 2 shows, diagrammatically, an electronic logic circuit used with the hydraulic circuit of FIG. 1.

A diagrammatic respresentation of the electronic circuit of the control panel 63 is shown in FIG. 2. The switch 64 can be moved between a high pressure or lift line 70 and a low pressure or compensation line 71. The flow meter or pressure switch 35 has a line **68*a* which carries a signal representing flow of fluid out of the ram 42 and a line 68*b* which carries a signal representing flow of fluid into the ram 42A. The pressure switch 60 is also shown with its line 67. The lines 67, 68*a* and 70 are connected to the input side of a 3 input AND gate 72, and the line 68*b* is connected to the input side of a 2 input AND gate 73, and the line 71 constitutes a reset line connected to the input sides of two electronic latches 74 and 75. The output line 76 of the gate 72 constitutes a set line connected to the input side of the latch 74. The output line 77 of the latch 74 is connected to the input side of the gate 73 and the output line 78 from the gate 73 constitutes a set line connected to the input side of the latch 75. The output line from the latch represents lines 65 and 66 for controlling the valves 30 and 34**.

Figure 3A:
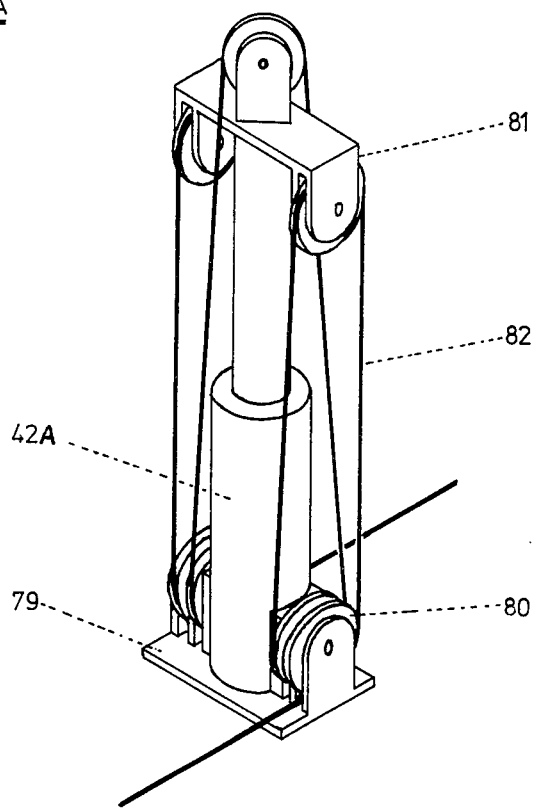
FIGS. 3A, 3B, 3C and 3D show various versions of a sea swell and shock load compensator including a ram or rams
Figure 3B:
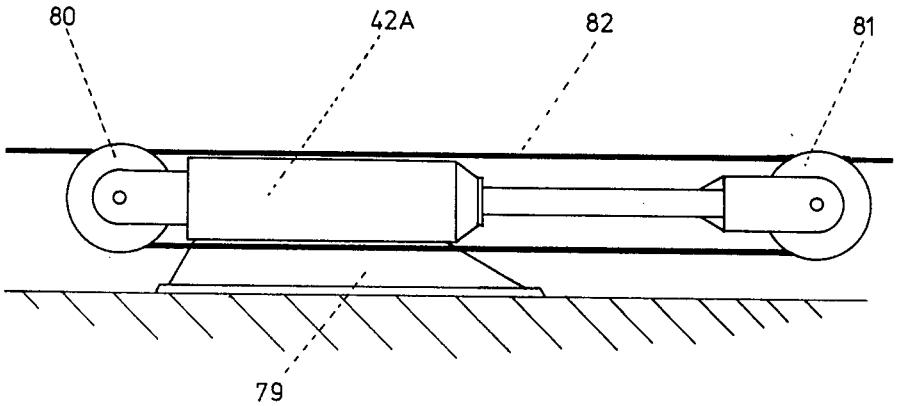
Figure 3C:
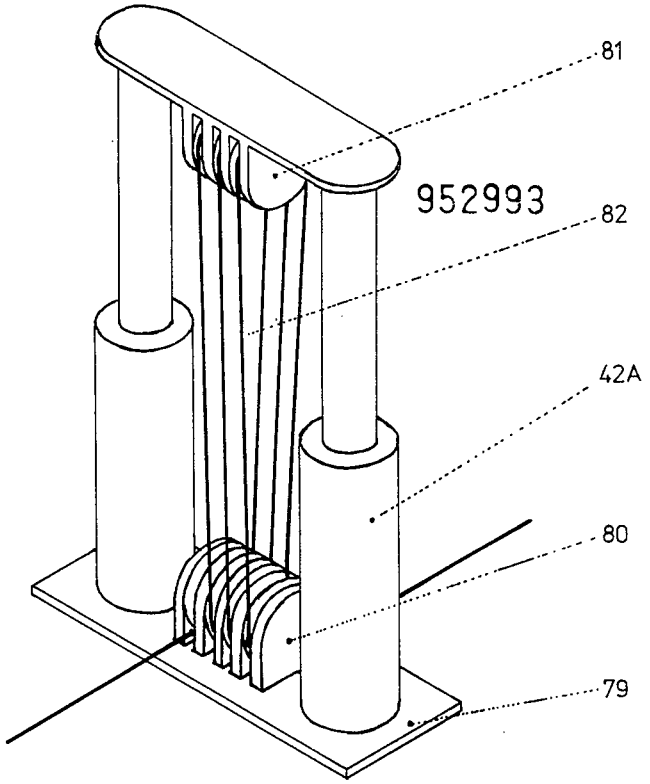

In FIG. 3A is shown the ram 42A, the upright cylinder of which is mounted at its lower end on a plinth 79. A sheave 80 of two pulleys is mounted on the plinth 79 at each side of the lower end of the ram cylinder and a sheave 81 of three pulleys is mounted on the upper end of the piston rod of the ram, one pulley being mounted above the upper end of the piston rod and turned about 45° around a vertical axis to facilitate reeving of a rope 82 extending from a winch drum or another point to the hook of a crane or hoist. FIG. 3B shows the ram of FIG. 3A but in a horizontal position. FIG. 3C shows an upright ram arrangement wherein there are two rams 42A mounted on the plinth 79 in parallel. Here, the sheaves 80 and 81 are mounted between the rams 42A.

Figure 3D:
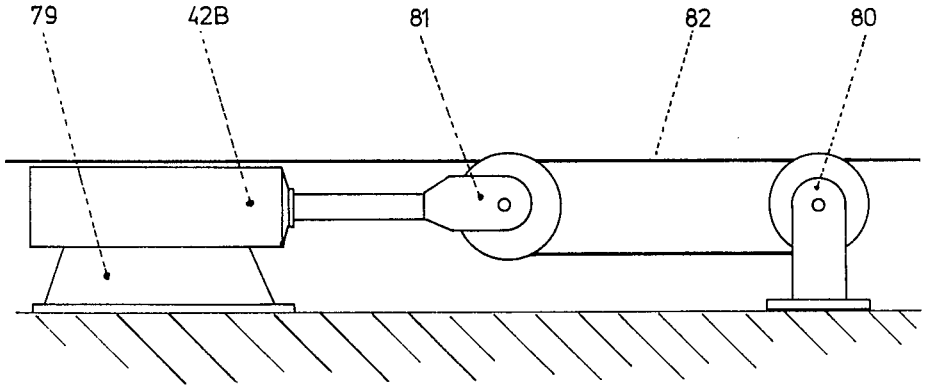
Figure 3E:
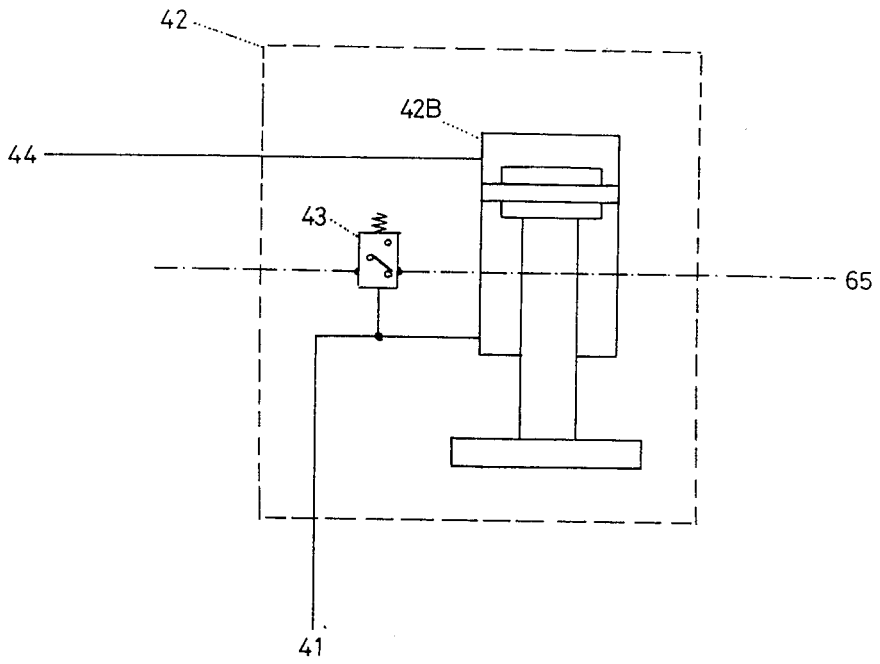
FIG. 3E shows a modification of the hydraulic circuit of FIG. 1 applicable to the use of the compensator of FIG. 3D.

In FIGS. 1, 3A, 3B and 3C the ram cylinder is pressurised at the side of the ram piston remote from the piston rod. FIG. 3D shows a ram 42B where the ram cylinder is pressurised at the piston rod side of the ram piston and FIG. 3E shows a modification of the compensator unit 42 in FIG. 1 according to FIG. 3D.

In priming the system shown in FIG. 1, shut off valves 9 and 62 are closed and shut off valves 11 and 59 are open. The pumps 14, 15 draw hydraulic fluid from the reservoir 1 through line 10 and deliver hydraulic fluid into lines 20 and 25. This establishes a hydraulic fluid supply in line 58 and the accumulator 57 and a hydraulic fluid supply in lines 36, 37, 38 and 39. As regards the charging of the accumulator 57, hydraulic fluid is pumped through the check valve 23 until the pressure on the pump side of the check valve 23 reaches a value such that the pressure relief valve 53 opens to return hydraulic fluid at excessive pressure to the reservoir 1. The pressure relief valve 53 thus sets the pressure in the accumulator 57 and the line 58 and when this set pressure is reached the pressure switch 60 is closed to energise the solenoid of the directional control valve 54 and thus open such valve so as to establish a direct connection from the line 20 to the common return line 40 and offload the pump 14. The closing of the pressure switch 60 also produces a signal in line 67 to control panel 63 indicating that the set pressure in accumulator 57 has been reached.

After low pressure or compensation operation, selection of high pressure or lift operation at the switch 64 produces a signal in line 70 of FIG. 2 so as to provide one of the three inputs to the 3 input AND gate 72. Another input to the gate 72 is produced by the closing of the switch 60. The third input to the gate is produced by the flow meter or pressure switch 35 sensing the flow of hydraulic fluid out of the ram 42A and through the open valve 34. When these three inputs exist simultaneously the gate 72 sends a signal to the latch 74 to set it to deliver a signal to provide one of the two inputs to the 2 input AND gate 73. When the flow meter or pressure switch 35 senses the flow of hydraulic fluid into the ram 42A through the open valve 34 the flow meter or pressure switch 35 produces the second input to the gate 73 and then sends a signal to the latch 75 to set it to deliver a signal to cause the solenoids of directional control valves 30 and 51 to be energised via line 66. Energisation of the solenoid of valve 30 causes communication between lines 36 and 38 to cease so that hydraulic pressure in line 36 opens the valve 30 so that communication is established between the accumulator 57 and the ram 42A via the lines 58, 29 and 41 through the restriction 31 which restricts flow of hydraulic fluid into the ram 42A to a constant rate regardless of the weight of the load being lifted, but which is bypassed by the check valve 32 to permit relatively unrestricted flow of hydraulic fluid out of the ram 42A so as to absorb minor increases in the effective weight of the load due to sea swell. In order to absorb inadvertent shock loads due for instance to some failure in the hoist system or to overloading, the pressure relief valve 47 is provided to pass hydraulic fluid from the ram 42A to the reservoir 1 via the lines 41, 46 and 40. The manually operable directional control valve 48 serves the same purpose as the valve 47 in the event of a power failure. Energisation of the solenoid of valve 51 establishes a direct connection between the accumulator 55 and the reservoir 1 via the lines 56, 49 and 40 so as to dump any surplus of hydraulic fluid in the accumulator 55 to a pressure predetermined by the setting of valve 51A. The opening of the valve 30 by a signal from switch 64 establishes communication between the accumulator 57 and the ram 42A extending or retracting the ram fully under a given maximum load. The selection of high pressure at switch 64 also de-energises the solenoid of valve 34 which opens communication between lines 37 and 39 so that the return spring closes the valve 34. The presence of high pressure in the ram 42 by virtue of a load being suspended from the hoist rope 82 increases the pressure in line 41 and this opens the pressure switch 43 so that the solenoid of valve 34 is isolated from switch 64 whilst any load is suspended from the hoist rope. This completes the switching over to high pressure or lift operation which occurs, by virtue of the electronic circuit of FIG. 2, only when three conditions are satisfied, viz, (a) the selection of high pressure or lift operation at the switch 64

(b) the attainment of the required pressure in the accumulator 57, and (c) the starting of flow of hydraulic fluid into the ram 42 from accumulator 55 so that lifting can only start at the foot of a swell.

After high pressure or lift operation selection of low pressure or compensation operation at the switch 64 produces a signal in line 71 of FIG. 2 so as to reset latches 74 and 75 and thereby de-energises the solenoids of valves 30 and 51. De-energisation of the solenoid of valve 30 opens direct communication between the lines 36 and 38 so that the return spring closes the valve 30 and isolates hydraulic fluid between the valves 30 and 34 and in line 41 and the ram 42A. De-energisation of the solenoid of valve 51 causes that valve to be closed by its return spring so that valve 51A ceases its function as a low pressure relief valve and valve 50 resumes its function as a high pressure relief valve. If a load is suspended from the hoist rope 82 this situation is maintained until the weight of the load is relieved, the isolated hydraulic fluid preventing movement of the ram 42A by the tension in the rope 82 due to the weight of the load. When the weight of the load is relieved, e.g., by the load making contact with the deck of a tender, the tension in the rope 82 is also relieved, so as to reduce the pressure in the ram 42 and the line 41. Reduction in the pressure in line 41 closes the pressure switch 43 and thereby energises the solenoid of the direction control valve 34. Energisation of the solenoid of valve 34 closes communication between the lines 37 and 39 so that the pressure in line 37 opens the valve 34 so that the formerly isolated hydraulic fluid can run into the line 56 and accumulator 55. This completes the switch over to low pressure or compensation operation which can only occur when two conditions are satisfied, viz, (a) the selection of low pressure or compensation at the switch 64, and (b) the weight of the load is relieved.

In a typical installation a crane comprises a slewable frame on which one end of a jib is pivoted. Mounted on the frame are three winches, the first winch being provided for luffing the jib, the second winch being provided as a whip hoist winch, i.e. one for the rapid hoisting of lighter loads, and the third winch being provided as a main hoist winch, i.e. one for the slower hoisting of heavier loads. Also mounted on the frame is a control cabin and three sea swell compensators. Each compensator may be as shown in FIG. 3A, 3B, 3C or 3D, the plinth 79 being mounted on the frame or on the jib.

Considering firstly the whip hoist system, the rope, e.g. 82, extends from the second winch so that the rope can be paid in and out. The rope extends to one of the three rams, e.g. 42A, and is reeved about the pulleys thereof so as to give for example a six-part fall. From the ram, the rope extends to a single-pulley sheave on the other end or head of the jib and from there to a means for connection with a load.

Turning now to the main hoist system, each end of a rope may be wound on the main hoist winch, the barrel of the winch may be divided for this purpose. Thus, the rope extends from one division of the barrel of the winch to one of the rams and is reeved about the pulleys thereof so as to give for example a six-part fall. Then the rope extends to an outer one of the pulleys of a three pulley sheave at the other end of the jib. The rope is reeved about this sheave and a suspended two pulley sheave carrying means for connection with a load and extends from the other outer one of the pulleys of the sheave at the other end or head of the jib to give a four-part fall. The rope extends back to the other of the rams and is reeved about the pulleys thereof so as to give another six-part fall. The rope then extends back to the other division of the barrel of the main hoist winch or to an anchor point if the hoist winch has an undivided barrel.

If one assumes that the stroke length of the piston of each ram is two meters, in the case of operation of the whip hoist system because of the six-part fall at the ram and the single-part fall at the jib head the vertical movement of a suspended load will amount to twelve meters for a full stroke movement of the piston, without rotation of the whip hoist winch. In the case of operation of the main hoist system, because of a six-part fall at each of the two rams and the four-part fall at the jib head the vertical movement of a suspended load will amount to six meters, i.e. $6\times2\times2\div4$ meters, for a full stroke movement of both pistons, without rotation of the main hoist winch.

Instead of the sheaves being mounted at opposite ends of a single ram, as previously described, the sheaves may be mounted between two rams disposed side-by-side as in FIG. 3C. Thus, for example, with a six-part fall arrangement a sheave of four pulleys may be mounted between the lower ends of the cylinders and a sheave of three pulleys may be mounted on a cross-member interconnecting the upper ends of the piston rods. Instead of the sheaves 80 and 81 being mounted at opposite ends of a single or double ram as in FIG. 3A, 3B or 3C they may be mounted at the piston rod end of the ram as shown in FIG. 3D so that the piston rod is in tension rather than compression due to the tension in the rope being rove round the looped configuration of 80 and 81.

In one mode of operating either hoist system, particularly with heavy or cumbersome loads to be lifted in adverse weather conditions, it is desirable to avoid shock loading of the crane and to give the crew of the tender time to stand clear of the load after they have attached it. The crane operator sets the switch 64 to low pressure or compensation operation. The load is attached to the load-connecting means without operating the hoist winch the ram or rams will allow the load connecting means to rise and fall with the load on the deck of the tender without lifting it from the tender. When the crew are clear and the crane jib is plumbed above the load, the switch 64 is set to high pressure or lift operation and the load is lifted by the ram extending or contracting under high pressure at the foot of a swell. The ram extending or contracting under high pressure, winds in hoist rope at a faster rate than the rising of the swell so that the load lifts off from the deck before the crest of the swell is reached. The speed of lifting may also be accelerated by winding in on the hoist winch.

In another mode of operating to be used only in relatively calm sea conditions the crane operator sets the switch 64 to high pressure or lift operation. This means that the ram or rams under compression as in FIG. 3A, 3B or 3C will be fully extended, or the ram or rams under tension as in FIG. 3D will be fully contracted, and will remain so under conditions of steady lift of the load. The load on the tender is attached and the appropriate winch is rotated to raise the load. Should the tender fall in a small swell, any shock load in excess of the designed safe load of the particular hoist to which the load is attached will be absorbed by the ram or rams compressing or extending. In this mode the system will act only as a shock absorber.

In a further mode of operating either hoist system when transferring a load to a tender, the load is lifted from the deck of the rig or platform with the ram or rams under high pressure so that it is or they are fully extended under compression or fully retracted under tension. The load is then swung overside and is lowered by the winch to a point near the top of the swell. Switch 64 is then set to low pressure and the load is lowered in small stages unti the tender rises to support the load at the top of a swell. The pressure in the ram falls so that pressure switch 43 closes thus opening valve 34. Thus compensation for sea swell commences and the load remains on the deck of the tender by the ram depressing and extending to keep a small tension in the hoist rope. The connecting means is released from the load by lowering on the hoist winch until the ram tops out and adequate slack rope is lowered onto the tender.

To facilitate the attachment or release of the connecting means from a load on the tender, two additional small ropes may be attached, in the case of the whip hoist system, to the hoist rope above the connecting means and so as to extend below the connecting means. These additional ropes may be led through rings on each side of the deck of the tender and to horn cleats so that the connecting means may be held steady in a position for attachment to or release from the load. Similar means may be provided with the main hoist system. These ropes may be used to cause the connecting means to rise and fall in the swell whilst slings from the load are being attached.

Each ram should be situated on the crane in such a position that there is sufficient distance between the hoist winch and the pulley of the sheaves from which the hoist rope extends to the hoist winch for the hoist rope to be distributed along the whole length of the hoist winch when winding-in. Thus the ram may be situated in any suitable position on the crane. The ram may be situated, for example, on the jib instead of the frame and may be vertical, inverted or at any angle.

Furthermore, the number of falls between the sheaves at both ends of each ram may be varied to suit the requirements of particular cranes bearing in mind the number of falls at the jib head and the amount of swell to be compensated for.

In addition to use in the transfer or support of a load between a fixed station (e.g. an oil rig) at which the hoist is installed and a floating station (e.g. a supply ship or tender) the invention has use in the transfer of a load between a fixed station at which the hoist is installed and the water itself, the transfer or support of a load between a floating station at which the hoist is installed and another floating station, and transfer of a load (e.g. a life boat) between a floating station (e.g. a ship) at which the hoist is installed and the water itself.

Furthermore, in addition to the application of the invention to a hoist having a winch and wherein the ram can only raise the load through a limited distance the winch being used for the remaining distance, the invention has application to a hoist which has no winch and the ram alone raises the load through the full distance.

In handling of flexible pipe through which fluent material may be transferred between a tender and a rig or platform the rig or platform may be provided with a crane or gantry for the purpose of handling such flexible pipe. The hoist winch is used to hoist part of the flexible pipe to a convenient height above the tender and a compensating rope is attached between the tender and the hook or other means for connection with the flexible pipe.

The ram of the compensator is pressurised to an extent sufficient to maintain the compensating rope in tension as the tender and the hoisted pipe rises and falls in the swell, thus preventing any load being borne by the end couplings of the flexible pipe other than the weight of the pipe itself.

Alternatively, the compensator previously described with reference to FIG. 1 could also include an intermediate pressure hydraulic system for the purpose of handling the flexible pipe in a swell.

The compensating rope and the pipe connections to the tender may be provided with quick release devices for emergency purposes should the tender be unable to maintain station.

Also envisaged is the provision of hydraulic or electrical means to cause the hoist winch to revolve when the ram of the compensator is nearing the limits of its travel in order to augment the amount of hoist rope being paid out or hove in by the compensator itself.

Figure 4:
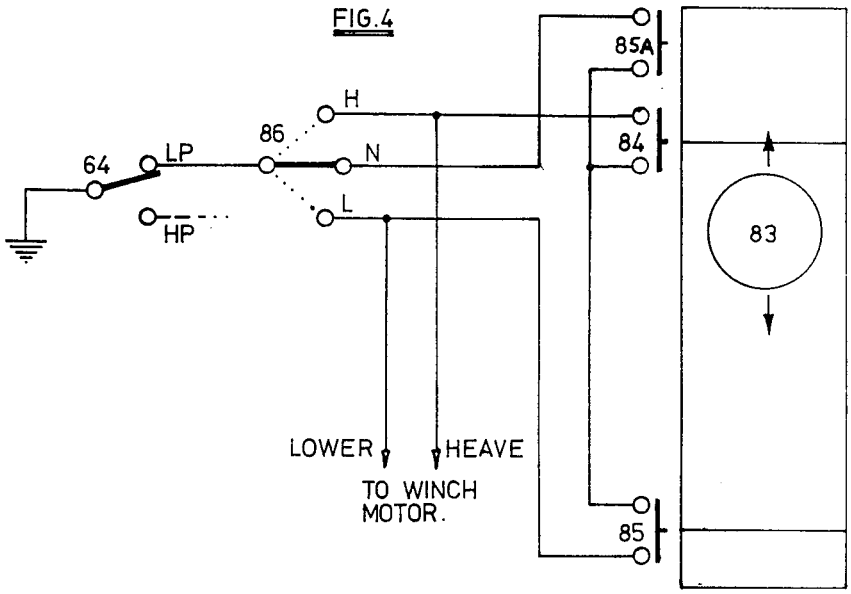
FIG. 4 shows, diagrammatically, means to operate the hoist winch when the ram of the compensator is nearing the limits of its travel.

Referring to FIG. 4 a ram position indicator may be provided in the driver's cab, the indicator including a disc 83, representing the ram head, movable between two contacts 84, 85. Switch 85A is an ON-OFF switch. With the control lever 86 for the hoist winch in the neutral position and the electrical circuit switched to compensation, electrical connection of the disc 83 with a respective contact 84 or 85 causes the hoist winch to be turned to either pay out or heave in hoist rope as required until the disc 83 ceases to be in electrical connection with the contact. Alternatively, the ram position indicator can be used merely for visual reference by the driver who operates the control lever for the hoist winch as appropriate to maintain the disc and therefore the ram head in a safe position clear of its limits of travel. Alternatively in lieu of the ram position indicator described, the ram position indicator may consist of a videoscope upon which the position of the ram head is traced by a device monitoring changes of pressure in the line 56.

It is also envisaged to enable the hoist rope to part company with the hoist winch in emergency conditions such as might be present when the crane hook is attached to a tender which is unable to maintain station and the hoist rope is paid out to the full.

Referring to FIG. 5A a forked hook 87 is provided on the winch drum and a light spring 88 holding a ferrule 89 in the forked hook. One end of the hoist rope has an eye 90 connected to the remainder of the rope via a tapered splice 91 and a roller buffer 92 is disposed between the winch drum and first sheave of the compensator with the rope passing through a nip between two rollers of the buffer. If the hoist rope is completely unwound from the winch drum fruther rotation of the winch drum tending to wind-on the hoist rope to the opposite hand pulls the ferrule 89 out of the forked hook 87 against the light spring 88 whereupon the ferrule strikes the roller buffer 92 and the hoist rope breaks at the tapered splice 91. FIG. 5B shows a modification wherein the forked hook 87 of FIG. 5A is replaced by a countersunk anchor point in the winch drum. Alternatively, there may be a small loop of hoist rope at the end of the tapered splice which is passed over a hook mounted on the winch drum, the loop being held on the hook by a light spring. In this instance the roller buffer 92 is not required.

In FIG. 6 is shown a further modified compensator unit 42 wherein the ram 42A or 42B described previously is replaced by a fixed displacement hydraulic pump-motor 42C which operates either as a pump or as a motor with inversion of direction of flow, the pump-motor 42C being capable of being driven by a winch 42D to act a as pump when hoist rope 82 is being paid out, and of driving the winch 42D to act as a motor when hoist rope 82 is being hove in. The pump-motor 42C can be switched into and out of the hydraulic circuit of FIG. 1 by solenoid-operated 3/2 directional control valves 42E connected at both sides of the pump-motor 42C. As shown in FIG. 4, the pump-motor 42C is switched out of the hydraulic circuit of FIG. 1 and is connected between lines 41A and 44A of another hydraulic circuit for operating the winch 42D.

What is claimed is:

1. A sea swell and shock load compensator comprising a hydraulically-operated means for heaving in and paying out a hoist rope, a high pressure hydraulic system for supplying hydraulic fluid to the means so as to enable the means to heave in the hoist rope when carrying a load under a given maximum load, and a low pressure hydraulic system for supplying hydraulic fluid to the means so as to enable the means to heave in the hoist rope when carrying a load under a given lesser load, the hydraulic systems being pressurised by gas-loaded accumulators, and selection means for selectively connecting the hydraulic systems with the hydraulically-operated means.

2. A compensator according to claim 1, also including an intermediate pressure hydraulic system.

3. A compensator according to claim 1, wherein the hydraulically operated means is a ram having sheaves for reeving the hoist rope into a looped configuration and the ram is operative to heave in the hoist rope by lengthening the looped configuration.

4. A compensator according to claim 1, wherein the hydraulically-operated means comprises a pump-motor in driving relation with a winch, the pump-motor being operative as a hydraulic motor to drive the winch in the sense to heave in the hoist rope and as a hydraulic pump to be driven by the winch in the sense to pay out the hoist rope.

5. A hoist for use in transferring or supporting a load either between two stations at least on of which is floating in water subject to a swell or between a single station, which is either floating in the water or fixed, and the water itself, and for installation at either of the two stations or at the single station, the hoist comprising a hoist rope, means for attaching a load to the hoist rope, a hydraulically-operated means to heave in and pay out the hoist rope, two hydraulic systems connected to the hydraulically-operated means, and selection means for selectively putting one of said systems into communication with the hydraulically-operated means and isolating the other from the hydraulically-operated means, each one of the hydraulic systems including a gas-loaded accumulator, the hydraulically-operated means being biassed towards heaving in the hoist rope by the gas pressure in the accumulator in the hydraulic system with which the hydraulically-operated means is in communication, and the accumulators being gas-loaded to different predetermined pressures, one of which pressures is lower than that required to enable the hydraulically-operated means to support the weight of a load but high enough to maintain tension in the hoist rope when the load-attaching means is attached to a load substantially supported by means other than the hoist rope and thereby to compensate for relative motion between the two stations or between the single station and the water, and the other of which pressures is at least sufficient to enable the hydraulically-operated means to heave in the hoist rope when the hoist rope is tensioned and the load is entirely supported by the hoist rope.

6. A hoist according to claim 5, also including an intermediate pressure hydraulic system with its own gas-loaded accumulator.

7. A hoist according to claim 5, wherein the hydraulically-operated means is a ram having sheaves for reeving the hoist rope into a looped configuration and the ram is operative to heave in the hoist rope by lengthening the looped configuration.

8. A hoist according to claim 7, including a winch and means whereby the winch can be operated automatically to augment the heaving-in or paying-out of hoist rope by the compensator when the ram is nearing its limit of travel.

9. A hoist according to claim 5, wherein the hydraulically-operating means comprises a pump-motor in driving relation with a winch, the pump-motor being operative as a hydraulic motor to drive the winch in the sense to heave in the hoist rope and as a hydraulic pump to be driven by the winch in the sense to pay out the hoist rope.

10. A hoist according to claim 5, including a winch and means thereon to enable the hoist rope to part company with the winch in the event of the winch having fully paid-out the hoist rope.

* * * * *